US011174450B2

(12) United States Patent
Asai et al.

(10) Patent No.: US 11,174,450 B2
(45) Date of Patent: Nov. 16, 2021

(54) GREASE COMPOSITION FOR RESIN LUBRICATION AND SLIDING MEMBER HAVING SLIDING SURFACE MADE OF RESIN

(71) Applicant: MINEBEA MITSUMI INC., Nagano (JP)

(72) Inventors: Yusuke Asai, Komoro (JP); Daiki Yamamoto, Nagano (JP); Takuya Kitajima, Nagano (JP); Motojiro Tsuna, Nagano (JP)

(73) Assignee: Minebea Mitsumi Inc., Nagano (JP)

( * ) Notice: Subject to any disclaimer, the term of this patent is extended or adjusted under 35 U.S.C. 154(b) by 0 days.

(21) Appl. No.: 16/523,180

(22) Filed: Jul. 26, 2019

(65) Prior Publication Data

US 2020/0032157 A1 Jan. 30, 2020

(30) Foreign Application Priority Data

Jul. 27, 2018 (JP) ..... JP2018-141700

(51) Int. Cl.
*C10M 169/00* (2006.01)
*C10N 10/02* (2006.01)
(Continued)

(52) U.S. Cl.
CPC .. *C10M 169/00* (2013.01); *C10M 2205/0265* (2013.01); *C10M 2205/0285* (2013.01);
(Continued)

(58) Field of Classification Search
CPC ..... C10M 169/00; C10M 2050/10; C10M 2205/0285; C10M 2207/1236;
(Continued)

(56) References Cited

U.S. PATENT DOCUMENTS 9,296,974 B2 * 3/2016 Yamamoto ..... C08F 220/18
2005/0221999 A1 * 10/2005 Nakatani ..... C10M 169/06 508/480
(Continued)

FOREIGN PATENT DOCUMENTS

JP 63137995 A * 6/1988
JP 2006-182923 A 7/2006
(Continued)

OTHER PUBLICATIONS

Office Action dated May 27, 2020 in the corresponding Japanese Patent Application No. 2018-141700 with the English translation thereof.

*Primary Examiner* — James C Goloboy
(74) *Attorney, Agent, or Firm* — Carrier Blackman & Associates, P.C.; Joseph P. Carrier; Anne G. Sabourin

(57) ABSTRACT

The invention provides a grease composition for lubrication of a sliding surface made of resin, including a fluorine-based base oil and a synthetic hydrocarbon oil as a base oil; a fluorine-based thickener, and a lithium soap thickener or a lithium complex soap thickener as a thickener; and an extreme pressure additive as an additive. The invention also provides a sliding member including a sliding surface made of a resin wherein the grease composition for lubrication is applied to the sliding surface made of a resin.

5 Claims, 7 Drawing Sheets

(51) Int. Cl.

| | |
|---|---|
| ***C10N 30/02*** | (2006.01) |
| ***C10N 30/06*** | (2006.01) |
| ***C10N 40/04*** | (2006.01) |
| ***C10N 40/14*** | (2006.01) |
| ***C10N 50/10*** | (2006.01) |
| ***C10N 20/02*** | (2006.01) |

(52) U.S. Cl.
CPC ..... *C10M 2207/1236* (2013.01); *C10M 2207/1256* (2013.01); *C10M 2207/1285* (2013.01); *C10M 2213/0606* (2013.01); *C10M 2213/0626* (2013.01); *C10M 2215/064* (2013.01); *C10M 2215/0813* (2013.01); *C10M 2217/0456* (2013.01); *C10N 2010/02* (2013.01); *C10N 2020/02* (2013.01); *C10N 2030/02* (2013.01); *C10N 2030/06* (2013.01); *C10N 2040/04* (2013.01); *C10N 2040/17* (2020.05); *C10N 2050/10* (2013.01)

(58) Field of Classification Search
CPC .. C10M 2207/1245; C10M 2207/1256; C10M 2207/1285; C10M 2213/04; C10M 2213/043; C10M 2213/0606; C10M 2213/0626; C10M 2215/064; C10M 2215/0813; C10M 2217/0456; C10M 2223/041; C10M 2223/047; C10M 2223/065; C10N 2010/05; C10N 2020/02; C10N 2030/02; C10N 2030/06; C10N 2040/04; C10N 2040/14; C10N 2040/17; C10N 2050/10
See application file for complete search history.

(56) References Cited

U.S. PATENT DOCUMENTS

| | | | | |
|---|---|---|---|---|
| 2005/0261141 | A1* | 11/2005 | Iso | F16C 33/6611 508/154 |
| 2007/0075046 | A1* | 4/2007 | Nakamura | C10M 169/00 218/123 |
| 2007/0213240 | A1* | 9/2007 | Shimura | C10M 169/06 508/588 |
| 2008/0016516 | A1 | 1/2008 | Brunswig et al. | |
| 2009/0270290 | A1 | 10/2009 | Sawaguchi et al. | |
| 2010/0190668 | A1* | 7/2010 | Hishinuma | C10M 169/02 508/182 |
| 2011/0218128 | A1* | 9/2011 | Hishinuma | C10M 169/02 508/181 |
| 2014/0199009 | A1* | 7/2014 | Inami | C10M 169/02 384/462 |
| 2015/0045272 | A1* | 2/2015 | Fujimaki | C10M 141/06 508/503 |
| 2016/0298050 | A1* | 10/2016 | Kunishima | C08K 3/013 |

FOREIGN PATENT DOCUMENTS

| | | | |
|---|---|---|---|
| JP | 2008-101122 | A | 5/2008 |
| JP | 2016-139589 | A | 8/2016 |
| WO | 2016/158070 | A1 | 10/2016 |

* cited by examiner

GREASE COMPOSITION FOR RESIN LUBRICATION AND SLIDING MEMBER HAVING SLIDING SURFACE MADE OF RESIN

CROSS REFERENCES TO RELATED APPLICATIONS

This application is based on Japanese Patent Application (No. 2018-141700) filed on Jul. 27, 2018, the contents of which are incorporated herein by reference.

BACKGROUND OF THE INVENTION

1. Field of the Invention

The present invention relates to a grease composition for lubrication of a sliding surface made of resin and a sliding member having a sliding surface made of resin.

2. Description of the Related Art

In JP-A-2016-139589, a sliding switch (resin sliding member) for improving waterproof property is proposed.

SUMMARY OF THE INVENTION

When a sliding member having a sliding surface made of a resin (hereinafter also referred to the member as "resin sliding member" and referred to the surface as "resin sliding surface") is used in an environment of easily being in contact with water, the grease composition applied to the sliding surface tends to be easily removed from the sliding surface.

The loss of the grease composition from the resin sliding surface tends to bring on an adverse effect that may cause on the resin sliding surface a rapid increase in the frictional force and an increase in the amount of wear, whereby the service life of the product provided with the resin sliding surface may be shortened.

Therefore, in a case of using the resin sliding member in environments where contact with water is likely to occur, for example, in an underwater environment, there is a demand for a grease that can achieve reduction of friction and wear without being removed from the sliding surface.

The present invention has been made in view of such a situation. An object of the present invention is to provide a grease composition which is excellent in adhesiveness to a resin sliding surface and excellent in lubricity, particularly in an environment of easily being in contact with water. Another object of the present invention is to provide a resin sliding member which is capable of reducing friction and wear and realizing a long service life by the application of the grease composition.

As a result of intensive studies to achieve the above object, the present inventors have found that by blending a fluorine-based base oil and a synthetic hydrocarbon oil as a base oil, a fluorine-based thickener and a lithium soap thickener or a lithium complex soap thickener as a thickener, and an extreme pressure additive, the grease composition becomes excellent in the adhesiveness and excellent in lubricant properties, and thereby the present invention has been completed.

One embodiment of the present invention is a grease composition for lubrication of a sliding surface made of a resin, including: a fluorine-based base oil and a synthetic hydrocarbon oil, as a base oil; a fluorine-based thickener, and a lithium soap thickener or a lithium complex soap thickener, as a thickener; and an extreme pressure additive as an additive, wherein the synthetic hydrocarbon oil has a kinetic viscosity at 40° C. of 30 to 220 $mm^2/s$.

As a preferred embodiment of the present invention, it is preferable that the extreme pressure additive is at least one selected from the group consisting of a phosphorus extreme pressure additive and a macromolecular ester extreme pressure additive.

Further, it is preferable that the grease composition for resin lubrication has a worked penetration in the range of 265 to 340.

The present invention also relates to a sliding member including a sliding surface made of a resin, wherein the above-described grease composition is applied to the sliding surface.

Among the preferred embodiments of the sliding member according to the present invention, it is preferable that the sliding member be a sliding switch or a gear device.

According to the present invention, the grease composition for resin lubrication having the configuration above can improve the adhesiveness to the application place (sliding surface) and can impart excellent lubricant properties. Accordingly, by applying the grease composition for resin lubrication according to an embodiment of the present invention to a resin sliding member, the removal of the grease from the sliding surface of the resin sliding member is reduced, thus the excellent lubricant properties inherent to the grease itself can be maintained, and the friction and wear in the sliding surface are reduced, which lead to realize an extension of the service life of the resin sliding member.

BRIEF DESCRIPTION OF THE DRAWINGS

FIG. 1A is a sectional view illustrating a sliding switch in switch off position viewed from the front.

FIG. 1B is a sectional view illustrating the sliding switch in switch on position viewed from the front.

FIG. 2A is a front view illustrating the multi-stage gear device.

FIG. 2B is a side view (partially including a cross section) illustrating the multi-stage gear device.

DETAILED DESCRIPTION OF THE EMBODIMENTS

Figure 1A:
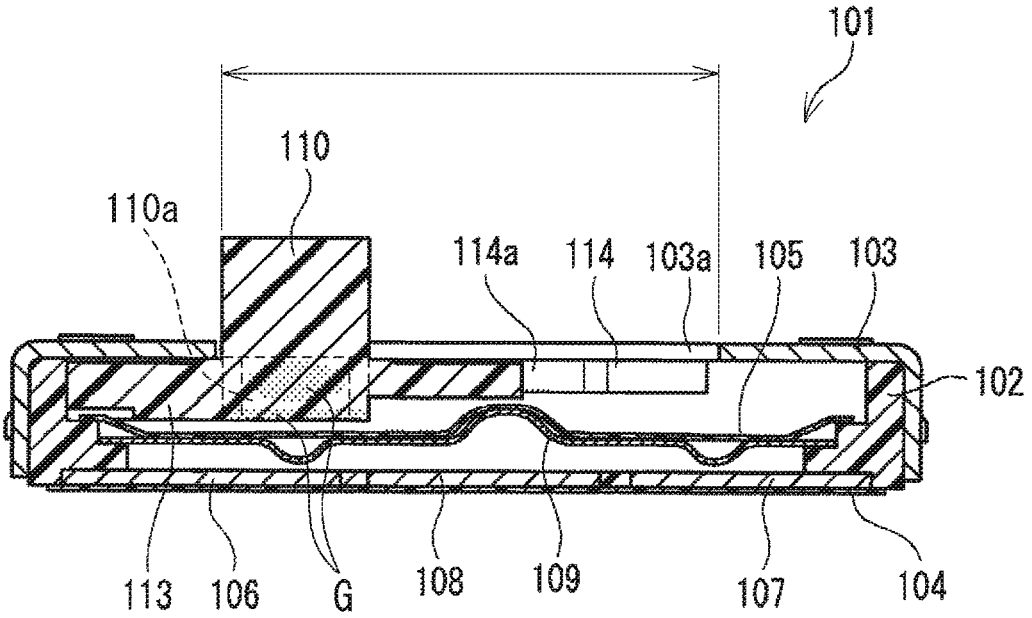
FIG. 1A and FIG. 1B are a schematic view illustrating a structure of one embodiment (sliding switch) of the sliding member according to the present invention.

As described above, in an environment which is easy to come in contact with water, for example in an underwater environment or an environment where dew condensation easily occurs (hereinafter, collectively referred to as a water contact environment), there is a problem that a grease removal from the applied surface is likely to occur. For example, a sliding switch disclosed in JP-A-2016-139589 is provided with a waterproof sheet made of resin to improve waterproof property thereof, taking into consideration a possibility of being used in a water contact environment, and as described later, the sliding switch performs on and off of the switch through the waterproof sheet. At this time, the grease is used to improve the lubricity of the waterproof sheet and the slider, and the lubricity of the slider and other contact surfaces. However, if the grease has poor adhesiveness, the grease may be removed during use of the switch (execution of ON and OFF), whereby the frictional force between the slider and the waterproof sheet may increase, and wear and damage of the waterproof sheet may occur, which result in shortening the service life of the sliding switch.

In addition, even with regard to a sliding member other than the sliding switch, if loss of the grease from the sliding surface occurs when using the sliding member in a water contact environment, the frictional force on the sliding surface will increase similarly, and also an increase in the amount of wear or failure of the sliding member may occur.

In order to solve these problems, the present inventors have studied a grease composition excellent in adhesiveness to a sliding surface made of a resin, and as a result, it has been found that by blending the greases containing a fluorine-based base oil and a synthetic hydrocarbon oil as a base oil, a fluorine-based thickener and a lithium soap thickener or a lithium complex soap thickener as a thickener, and an extreme pressure additive, the adhesiveness of the grease is especially increased in an environment in contact with water, and the lubricant properties also are excellent.

A grease composition for resin lubrication according to the present invention is characterized by combining and blending a specific base oil and a specific thickener, and an extreme pressure additive. The details will be described below.

Resin Sliding Member

The resin sliding member applied with the grease composition for resin lubrication according to the present invention is not particularly limited, and the examples include a sliding switch, a gear device, a bearing, and the likes.

The resin sliding member as the subject of the present invention is not particularly limited as long as it is a sliding member including a sliding surface made of resin in at least a portion thereof. Therefore, as described above, not only the sliding switch, the gear device, and the bearing but also other various slide members are included, and these slide members are also the subject of the present invention.

The resin sliding member of the present invention has a sliding surface made of a resin applied with a resin lubricating grease composition described below, i.e., a resin sliding surface having at least a portion covered with the resin lubricating grease composition. The resin sliding surface can be covered with the resin lubricating grease composition, for example, by applying the grease composition directly on the resin sliding surface or by enclosing the grease composition in the sliding member).

Hereinafter, each of the preferred embodiments of the sliding member will be described in detail with reference to the attached drawings, but the present invention is not limited by the following embodiments.

Sliding Switch

Figure 1B:
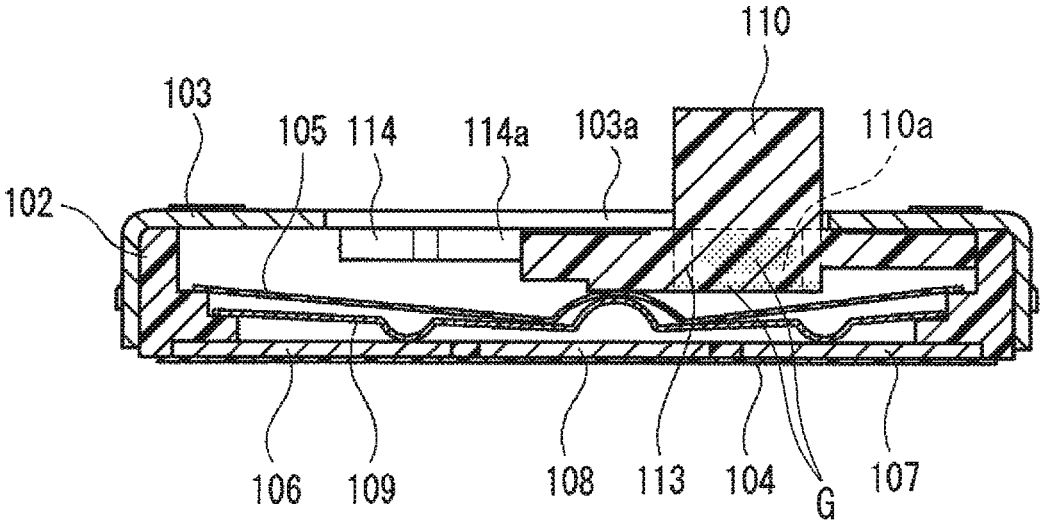

FIG. 1A and FIG. 1B illustrate a cross section of a sliding switch 101 according to a preferred embodiment of the present invention as viewed from the front.

In one example illustrated in FIG. 1A and FIG. 1B, the sliding switch 101 is provided with a housing 102, a cover 103, a first waterproof film 104, a second waterproof film 105, a first fixed contact 106, a second fixed contact 107, a third fixed contact 108, a movable contact 109, a slider 110, a contact operation unit 113, and a click spring 114.

As illustrated in FIG. 1A and FIG. 1B, the housing 102 and the cover 103 form a case by combining them. The housing 102 is made of an insulating material, and the cover 103 is made of a metal such as stainless steel. Note that, the cover 103 may be also formed of an insulating material.

The first waterproof film 104 and the second waterproof film 105 are provided to enhance the waterproof property of the sliding switch 101 as described later. As illustrated in FIG. 1A and FIG. 1B, the first waterproof film 104 is mounted on the outer surface of the housing 102, and the second waterproof film 105 is mounted on the inside of the housing 102.

Further, the first fixed contact 106, the second fixed contact 107, and the third fixed contact 108 are fixed to the housing 102, between the first waterproof film 104 and the second waterproof film 105. The first fixed contact 106, the second fixed contact 107, and the third fixed contact 108 are formed of a conductive material, and are separated electrically insulated from each other by the housing 102. Although not shown in FIG. 1A and FIG. 1B, end portions of the first fixed contact 106, the second fixed contact 107 and the third fixed contact 108 are respectively exposed at the bottom of the housing 102, and are used as connection terminals to an external circuit.

The movable contact 109 is formed of a conductive material. As illustrated in FIG. 1A and FIG. 1B, the movable contact 109 is displaceable between a separation position (ON position, FIG. 1A) separated from two of the first fixed contact 106 and the second fixed contact 107, and a connection position (OFF position, FIG. 1B) being in contact with the first fixed contact 106 and the second fixed contact 107. The movable contact 109 is formed of an elastic member and is configured to be in the separation position in an unloaded state (FIG. 1A).

The slider 110 is formed of an insulating resin material. As illustrated in FIG. 1A, the slider 110 is supported in the inside of the housing 102. The slider 110 is movable in the longitudinal direction of the housing 102 between the OFF position and the ON position (in FIG. 1A, the range indicated by the two-headed arrow is a movable range of the slider 110).

The cover 103 is provided with a slide groove 103*a* extending in the longitudinal direction of the housing 102. The slide groove 103*a* is configured to guide a movement of the slider 110 between the OFF position and the ON position.

In addition, the slider 110 is provided with a contact operation unit 113. The contact operation unit 113 is configured to displace the movable contact 109 from the separation position to the contact position via the second waterproof film 105 by moving the slider 110 from the OFF position to the ON position.

FIG. 1B illustrates a state in which the slider 110 is moved to the ON position along the slide groove 103*a* from the state illustrated in FIG. 1A. With the movement of the slider 110, the contact operation unit 113 provided to the slider 110 displaces the movable contact 109 via the second waterproof film 105. When the movable contact 109 is in contact with the first fixed contact 106 and the second fixed contact 107, the first fixed contact 106 and the second fixed contact 107 are electrically connected via the movable contact 109.

In a case where a conductive state of the first fixed contact 106 and the second fixed contact 107 is disconnected, the above operation may be reversed. That is, the slider 110 is moved along the slide groove 103*a* toward the OFF position, and a pressing of the movable contact 109 by the contact operation unit 113 is released. The movable contact 109 is returned to the separation position by an elastic return force thereof. That is, the contact state between the movable contact 109, the first fixed contact 106, and the second fixed contact 107 is released.

With such a configuration, the first fixed contact 106, the second fixed contact 107, and the movable contact 109 are disposed between the first waterproof film 104 and the second waterproof film 105, the separation and connection of the two are performed by the contact operation unit 113 provided to the slider 110 via the second waterproof film 105. However, moisture can penetrate the housing 102 from the outside through an opening of the slide groove 103*a*.

The sliding switch 101 also includes a pair of click springs 114 (elastic members). Each click spring 114 has a convex portion 114*a*. On the other hand, the slider 110 is provided with a pair of convex portions 110*a*.

When the slider 110 is moved between the OFF position and the ON position, each of the convex portion 110*a* of the slider 110 displaces the convex portion 114*a* of the click spring 114 in the short direction of the housing 102 (perpendicular to the sectional view of FIG. 1A) while elastically deforming the opposing click spring 114. When each of the convex portions 110*a* of the slider 110 passes the convex portion 114*a* of the opposing click spring 114, the elastic return force of the click spring 114 assists the movement of the slider 110 to the ON position or the OFF position, and gives a click feeling to the switch.

In the sliding switch 101, the second waterproof film is formed of, for example, a polyamide resin such as nylon, or a polyphthalamide (PPA) resin material. In addition, the slider 110 may be formed of, for example, an insulating resin material such as polyamide (PA), polyphenylene sulfide (PPS), and polyphthalamide (PPA).

In the sliding switch 101 of this embodiment, a grease composition G for resin lubrication according to an embodiment of the present invention is applied to a contact portion (a lower portion of the slider 110 is a resin sliding surface) between the contact operation unit 113 in the slider 110 and the second waterproof film 105, and to each convex portion 110*a* (the resin sliding surface) of the slider 110. That is, the grease composition G for resin lubrication is applied to the resin sliding surface of the sliding switch 101. The sliding switch 101 uses the grease composition G having an excellent adhesiveness for the resin sliding surface and an excellent lubricity, as described below, even in an environment that water penetrates the housing 102 from the slide groove 103*a*. Therefore, in the sliding switch 101, friction and wear are reduced, and a prolonged service life can be achieved.

Gear Device

As an example of a gear device according to a preferred embodiment of the present invention, a multi-stage gear device provided in an actuator will be described.

Note that, the "multi-stage gear device" to which the grease composition for resin lubrication according to an embodiment of the present invention is applied represents a multi-stage gear device provided with at least one gear made of resin, and the multi-stage gear device may be configured so that a resin gear and a gear made of a material other than resin such as a metal gear may be mixed, or only a resin gear may be used.

The grease composition for resin lubrication as described later is applied to a bearing of the resin gear, and an engaging portion between the resin gear and a gear formed of a resin or a material other than the resin.

Figure 2A:
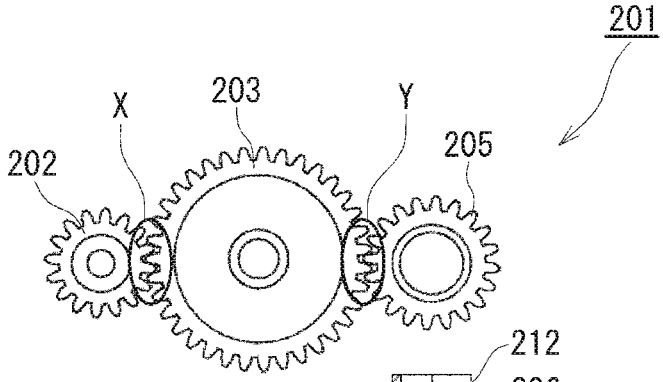
FIG. 2A and FIG. 2B are a schematic view illustrating a structure of another embodiment (multi-stage gear device) of the sliding member according to the present invention.
Figure 2B:
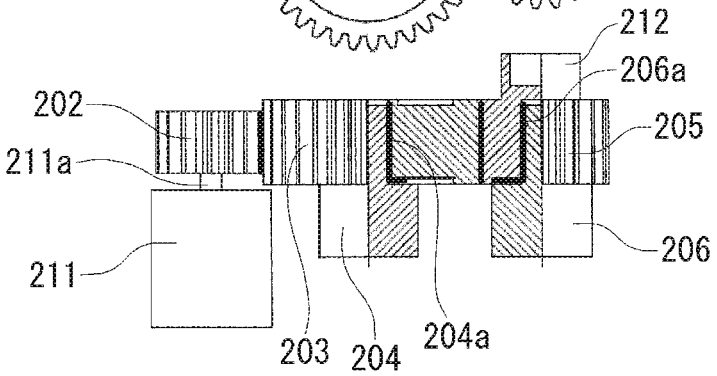

FIG. 2A and FIG. 2B are a schematic view for illustrating a multi-stage gear device 201 provided in an actuator, and FIG. 2A is a front view illustrating the multi-stage gear device 201 and FIG. 2B is a side view (including some cross sections) illustrating the multi-stage gear device 201. In addition, FIG. 2B also illustrates a motor 211 and an output shaft 211*a* thereof, and an actuator output shaft 212, in addition to the multi-stage gear device 201.

The multi-stage gear device 201 as illustrated in FIG. 2A and FIG. 2B includes a first gear 202 mounted integrally rotatable on the output shaft 211*a* of the motor 211, a second gear 203 engaged with the first gear 202, and the third gear 205 engaged with the second gear 203. Further, in FIG. 2A and FIG. 2B, a shaft 204 of the second gear 203 and a shaft 206 of the third gear 205 are illustrated, and the output shaft 212 of the actuator described above is also illustrated.

In the present embodiment, the grease composition for resin lubrication as described later is applied to an engagement portion X of the first gear 202 and the second gear 203, an engagement portion Y of the second gear 203 and the third gear 205, a bearing portion 204*a* of the second gear 203, and a bearing portion 206*a* of the third gear 205 showed in FIG. 2A and FIG. 2B.

In the multi-stage gear device 201, shafts included in the device, that is, the shafts (204 and 206) of the multi-stage gear device, and the output shaft 202*a* of the motor and output shaft 212 of the actuator may be made of metal or a resin, and, for example, the following configuration can be employed.

For example, the output shaft 211*a* of the motor 211 is a rotating shaft made of metal. Since the first gear 202 is fixed to the output shaft 211*a* and the first gear 202 rotates together with the output shaft 211*a*, a bearing portion to relatively rotate the first gear 202 and the output shaft 211*a* does not exist between them.

On the other hand, both of the shaft 204 of the second gear 203 and the shaft 206 of the third gear 205 are a fixed shaft made of the resin. In addition, the second gear 203 and the third gear 205 slide and rotate relative to the respective fixed shaft. For this reason, in addition to the engagement portions X and Y between the gears, the grease composition for resin lubrication as described later is also applied to the bearing portion 204*a* between the second gear 203 and the shaft 204 (the fixed shaft) of the second gear and the bearing portion 206*a* between the third gear 205 and the shaft 206 (the fixed shaft) of the third gear.

Note that, as a resin which may be used as a resin member for constituting these gear devices (gears and shafts of the gears) and the actuator provided with the gear device (output shaft of the motor, base member, exterior member (case), output shaft of the actuator, and the like), polyethylene (PE), polypropylene (PP), ABS resin (ABS), polyacetal (POM), polyamide (PA), polycarbonate (PC), phenolic resin (PF), polyethylene terephthalate (PET), polybutylene terephthalate (PBT), polyphenylene sulfide (PPS), polyether sulfone (PES), polyimide (PI), and polyether ether ketone (PEEK) can be exemplified.

The gear device of the present embodiment is suitably used for an actuator used in a vehicle-mounted air conditioning processing system or the like. The vehicle-mounted air conditioning processing system is used in a wide temperature range of −40° C. to 100° C., and when used in these temperature cycles, dew condensation may occur inside the actuator and water droplets may adhere to a tooth surface and the grease.

Further, the gear device of the present embodiment is also suitably used, for example, as an actuator used for an automatic opening and closing device of a toilet seat or a toilet lid. In a case of the automatic opening and closing device of the toilet seat or the likes, water may fall on the actuator when cleaning.

Even in the gear device used in such an environment of being easily in contact with water, by applying the grease composition for resin lubrication of the present invention, friction and wear are reduced, and a prolonged service life can be achieved.

Grease Composition for Resin Lubrication

The grease composition for resin lubrication will be described.

Base Oil

In the grease composition for resin lubrication according to the present embodiment, a fluorine-based base oil and a synthetic hydrocarbon oil are used as a base oil.

Examples of the fluorine-based base oil include base oil containing perfluoropolyether (PFPE) as a main component. The PFPE is a compound represented by General Formula: $RfO(CF_2O)_p(C_2F_4O)_q(C_3F_6O)_rRf$ (Rf: perfluoro lower alkyl group, p, q, r: integer).

The perfluoropolyether is roughly classified into a linear type and a side chain type, and the linear type has a smaller temperature dependency of kinetic viscosity than side chain type. This means that the linear type has a lower viscosity than the side chain type in a low temperature environment, and has a higher viscosity than the side chain type in a high temperature environment. For example, in a case of using a grease in a high temperature environment, from the viewpoint of suppressing the leakage of grease from the applied location and the lack of lubricant caused thereby, it is desirable that the viscosity in high temperature environment be high, that is, the use of a linear perfluoropolyether is preferred.

As the above synthetic hydrocarbon oil, for example, polyalphaolefin (PAO) such as normal paraffin, isoparaffin, polybutene, polyisobutylene, 1-decene oligomer, co-oligomer of 1-decene, and ethylene is preferable.

The present inventors have studied a configuration that provides an optimal viscosity of the grease composition as an indicator of the good adhesiveness and an optimal coefficient of friction as an indicator of the good lubricant properties, and as a result, it has been found that in addition to the composition of the grease composition, the value of the kinetic viscosity of the synthetic hydrocarbon oil is also one important factor.

Figure 6:
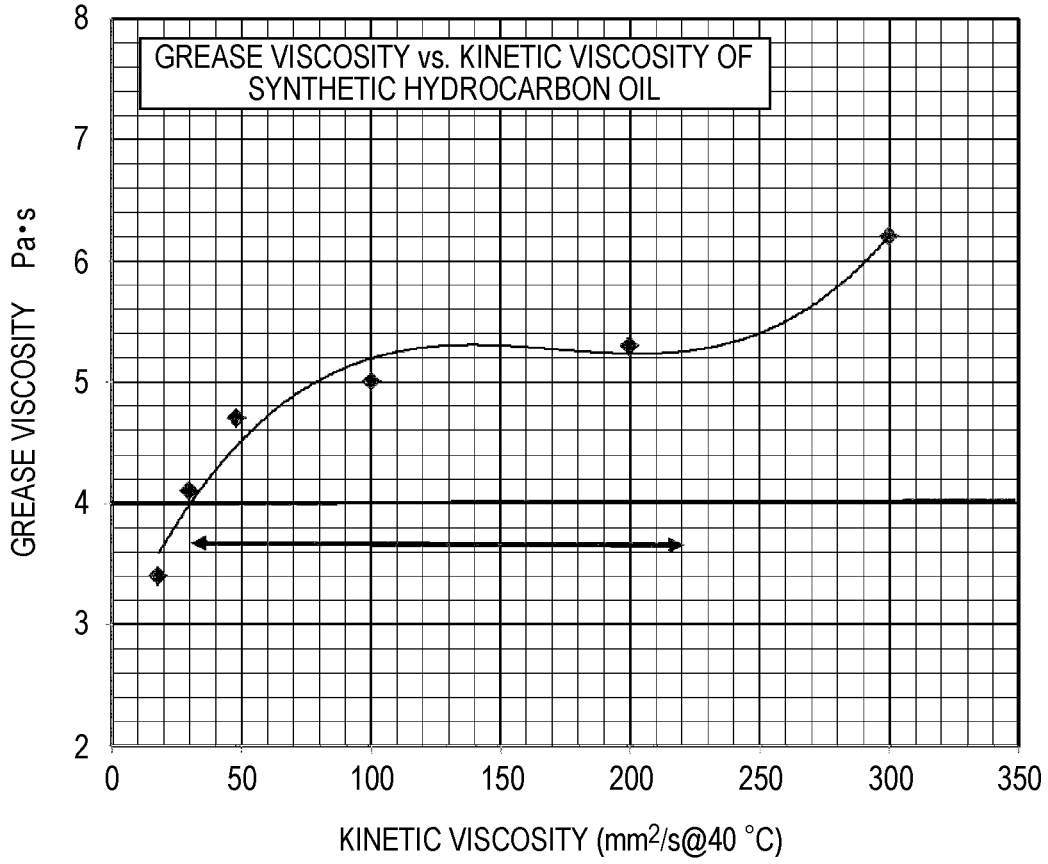
FIG. 6 illustrates the measured value of viscosity (Pa·s) for the grease compositions of Examples 1 to 4 and Comparative Examples 8 and 9 in relation to the value of kinetic viscosity at 40° C. of the used synthetic hydrocarbon oil (polyalphaolefin).
Figure 7:
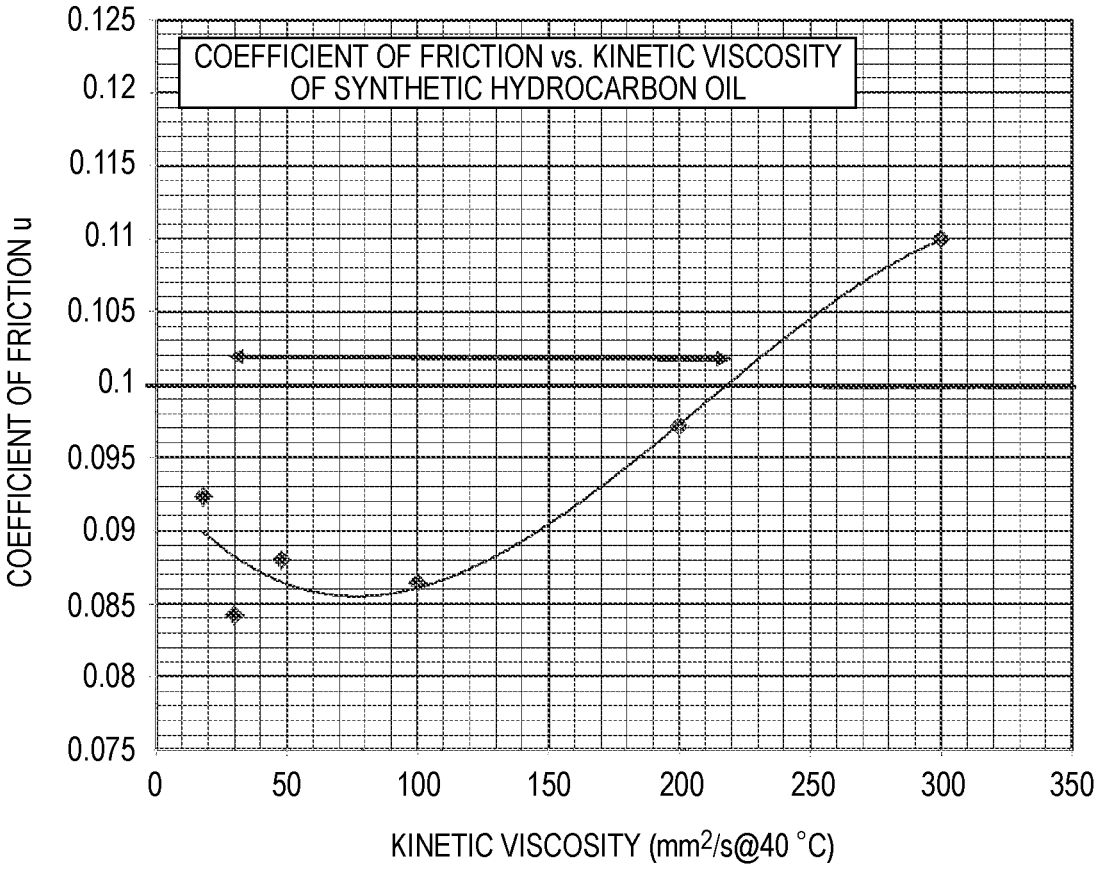
FIG. 7 illustrates the measured value of coefficient of friction for the grease compositions of Examples 1 to 4 and Comparative Examples 8 and 9 in relation to the value of kinetic viscosity at 40° C. of the used synthetic hydrocarbon oil (polyalphaolefin).

As an example, FIG. 6 shows the result of the viscosity measurement test of the grease composition, and FIG. 7 shows the result of the friction and wear test, when varying the value of the kinetic viscosity at 40° C. of the synthetic hydrocarbon oil (polyalphaolefin) from 18 to 300 $mm^2/s$ in the grease composition containing specific base oil, thickener and extreme pressure additive.

As illustrated in FIG. 6, it was confirmed that, when the kinetic viscosity at 40° C. of the synthetic hydrocarbon oil in the grease composition becomes lower than 50 $mm^2/s$, the viscosity of the grease composition starts to decrease sharply, and when it is lower than 30 $mm^2/s$, the viscosity is lower than 4 Pa·s. In addition, as illustrated in FIG. 7, it was confirmed that, when the kinetic viscosity at 40° C. of the synthetic hydrocarbon oil is higher than 100 $mm^2/s$, the coefficient of friction of the grease composition starts to increase rapidly, and when it is higher than 220 $mm^2/s$, the coefficient of friction is higher than 0.1.

As illustrated in the results of FIGS. 6 and 7, it could be confirmed that in the grease composition for resin lubrication including the fluorine-based base oil and the synthetic hydrocarbon oil, the fluorine-based thickener, the lithium soap thickener and the extreme pressure additive, when the kinetic viscosity at 40° C. of the synthetic hydrocarbon oil is set in the range of 30 to 220 $mm^2/s$, both the results of the viscosity measurement test (adhesiveness) and the friction and wear test (lubricant properties) are favorable. In FIGS. 6 and 7, the range indicated by the arrow parallel to the horizontal axis (kinetic viscosity) is the range of kinetic viscosity at 40° C. of the synthetic hydrocarbon oil which is capable of obtaining the excellent properties in both the viscosity measurement test and the friction and wear test.

Figure 8:
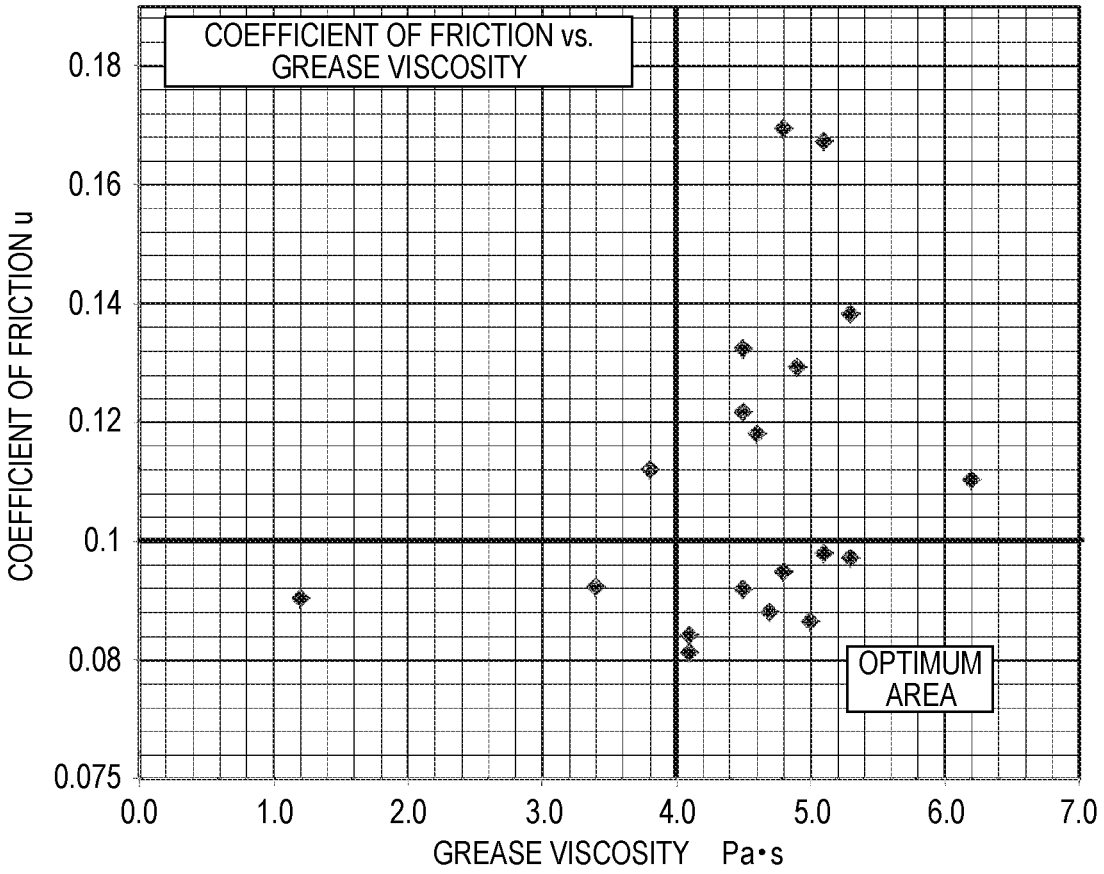
FIG. 8 illustrates the value of coefficient of friction for the grease compositions of Examples 1 to 8 and Comparative Examples 1 to 11 in relation to the value of viscosity (Pa·s).

Further, FIG. 8 illustrates the value of the coefficient of friction with respect to the value of viscosity (Pa·s) measured in various grease compositions prepared in Examples and Comparative Examples as described later. In FIG. 8, the grease compositions within the optimum area (viscosity of 4.0 Pa·s or higher and the coefficient of friction of 0.1 or lower) are the grease compositions which demonstrated the excellent results in both the viscosity measurement test and the friction and wear test.

As indicated by the above results, in the grease composition for resin lubrication of the present invention, it is preferable that the synthetic hydrocarbon oil have the kinetic viscosity at 40° C. in the range of 30 to 220 $mm^2/s$. Among them, the kinetic viscosity at 40° C. is more preferably to be in the range of 50 to 200 $mm^2/s$, and the most preferably in the range of 50 to 100 $mm^2/s$.

The mixing ratio of the fluorine-based base oil to the synthetic hydrocarbon oil is not particularly limited, and for example, with respect to the total content 100% by mass of the base oil, the ratio of the fluorine-based base oil to the synthetic hydrocarbon oil is usually (fluorine-based base oil amount:synthetic hydrocarbon oil amount)=(95% to 5% by mass:5% to 95% by mass), preferably (90% to 10% by mass:10% to 90% by mass), more preferably (80% to 20% by mass:20% to 80% by mass), and particularly preferably (75% to 22% by mass:78% to 25% by mass).

Further, the ratio of the total amount of base oil which is the sum of the fluorine-based base oil and the synthetic hydrocarbon oil with respect to the entire amount of the grease composition according to an embodiment of the present invention is usually 70% to 90% by mass, preferably 75% to 85% by mass and more preferably 80% to 85% by mass.

Thickener

In the grease composition of the present invention, a fluorine-based thickener, and a lithium soap thickener, or a lithium complex soap thickener are added as a thickener.

Among them, the grease composition of the present invention contains preferably 1% to 20% by mass, more preferably 5% to 15% by mass of the fluorine-based thickener, and preferably 1% to 15% by mass, more preferably 3% to 9% by mass of the lithium soap thickener or the lithium complex soap thickener, with respect to the entire amount of the grease composition.

The total amount (the total amount of thickeners) of the fluorine-based thickener and lithium soap thickener or the lithium complex soap thickener is usually 2% to 35% by mass, more preferably 5% to 30% by mass, much more preferably 10% to 30% by mass, and particularly preferably 10% to 20% by mass, with respect to the entire amount of the grease composition for resin lubrication.

Fluorine-Based Thickener

As the fluorine-based thickener, a fluorine resin particle is preferable. For example, particles of polytetrafluoroethylene (PTFE) are preferably used. The PTFE is a polymer of tetrafluoroethylene and is represented by the General Formula: $[C_2F_4]$, (n: degree of polymerization).

In addition, as the other fluorine-based thickener which may be used, for example, a perfluoro ethylene propylene copolymer (FEP), an ethylene tetrafluoro ethylene copolymer (ETFE), and a tetrafluoroethylene perfluoroalkyl vinyl ether copolymer (PFA) can be exemplified.

The size of the PTFE particle is not particularly limited. For example, polytetrafluoroethylene having an average particle diameter of 0.1 μm to 100 μm can be used. The shape of the PTFE particle is not particularly limited, and may be for example a spherical shape, a polyhedral shape, or a needle shape.

The fluorine-based thickener is usually used in amount of 1% to 20% by mass, and preferably 5% to 15% by mass, with respect to the entire amount of the grease composition.

Lithium Soap Thickener•Lithium Complex Soap Thickener

In the present invention, a lithium soap thickener is used in addition to the above-described fluorine-based thickener.

As the above lithium soap thickener, a lithium salt of aliphatic monocarboxylic acid can be used.

The aliphatic carboxylic acid above may be linear or branched, saturated or unsaturated, and in general, fatty acids having about 2 to 30 carbon atoms, preferably 12 to 24 carbon atoms can be used. Specifically, saturated fatty acid such as butyric acid, caproic acid, caprylic acid, pelargonic acid, capric acid, lauric acid, myristic acid, palmitic acid, stearic acid, and behenic acid, and unsaturated fatty acid such as oleic acid, linoleic acid, ricylic acid, and ricinoleic acid can be mentioned.

Among them, lithium salts of stearic acid, lauric acid, and ricinoleic acid, and lithium salt of compound in which the acid is substituted with a hydroxy group can be exemplified as typical examples of the lithium soap thickener.

In the present invention, a lithium complex soap thickener may be used instead of the lithium soap thickener.

The lithium complex soap thickener has improved heat resistance as compared with the lithium soap thickener by combining higher fatty acid with dibasic acid or inorganic acid (such as boric acid).

The lithium complex soap thickener may be obtained by reacting lithium hydroxide with aliphatic dicarboxylic acid having about 2 to 12 carbon atoms and aliphatic monocarboxylic acid having about 12 to 24 carbon atoms and at least one hydroxy group.

Examples of the aliphatic monocarboxylic acid having 12 to 24 carbon atoms and at least one hydroxy group include hydroxylauric acid, hydroxypalmitic acid, hydroxystearic acid, hydroxyoleic acid, hydroxyarachidic acid, hydroxybehenic acid, and hydroxylignoceric acid.

Examples of aliphatic dicarboxylic acids having 2 to 12 carbon atoms include oxalic acid, malonic acid, succinic acid, methylsuccinic acid, glutaric acid, adipic acid, pimelic acid, suberic acid, azelaic acid, sebacic acid, nonamethylenedicarboxylic acid, and decamethylene dicarboxylic acid.

The monocarboxylic acid and dicarboxylic acid may be used individually or in combination of two or more different kinds of the acids.

Among them, as the lithium complex soap thickener, a compound obtained by reacting lithium hydroxide with a combination of hydroxystearic acid and azelaic acid can be mentioned as a representative example.

The lithium soap thickener or the lithium complex soap thickener is usually used in an amount of 1% to 15% by mass, and preferably 3% to 9% by mass with respect to the entire amount of the grease composition.

Extreme Pressure Additive

The grease composition for resin lubrication of the present invention contains an extreme pressure additive (extreme pressure agent).

It is known that the extreme pressure additive has a function of reducing friction and wear of the metal surface and preventing seizure by reacting with a metal surface to form a lubricating film. For this reason, it is usually considered that even if a grease composition containing the extreme pressure additive was used in the resin sliding surface, no beneficial reaction would occur on the resin sliding surface. However, in the present invention, it was found that the coefficient of friction decreased when the grease composition for the resin sliding surface mixed with the extreme pressure additive was applied to the resin sliding surface.

Examples of the extreme pressure additive include a phosphorus compound, a sulfur compound, a chlorine compound, metal salts of a sulfur compound, and macromolecular ester.

Among them, in the present invention, it is preferable to use at least one of a phosphorus compound (phosphorus extreme pressure additive) and macromolecular ester (macromolecular ester extreme pressure additive) as the extreme pressure additive, and these may be used in various combinations.

Examples of the phosphorus extreme pressure additive include phosphoric acid ester, phosphorous acid ester, phosphoric acid ester amine salt, and thiophosphoric acid ester.

As a suitable phosphorus extreme pressure additive, for example, phosphoric triesters such as tricresyl phosphate (TCP), triphenyl phosphate, tributyl phosphate, trioctyl phosphate, and trioleyl phosphate, and thiophosphate triesters such as triphenoxy phosphine sulfide (TPPS) can be exemplified, and these are also available as commercial products.

Further, as the macromolecular ester extreme pressure additive, for example, ester of aliphatic monovalent carboxylic acid and divalent carboxylic acid, and polyhydric alcohol can be exemplified. Specific examples of the macromolecular ester extreme pressure additive include, for example, PERFAD (registered trademark) series and PRIOLUBE (registered trademark) series manufactured by Croda Japan KK, but it is not limited thereto.

The extreme pressure additive may be usually used in an amount of 0.1% to 10% by mass, preferably 0.1% to 5% by mass, and more preferably 0.5% to 3% by mass, with respect to the entire amount of the grease composition.

Other Additives

In addition to the above-described essential components, the grease composition for resin lubrication may optionally contain additives generally used in a grease composition as long as the effects of the present invention are not impaired.

Examples of such additives include an antioxidant, a metal deactivator, a rust preventive, an oiliness improver, a viscosity index improver, and a thickener other than the thickener as mentioned above.

In a case where these other additives are contained, the additional amount (total amount) is usually 0.1% to 10% by mass with respect to the total amount of the grease composition.

For example, examples of the antioxidant include hindered phenolic antioxidant such as octadecyl-3-(3,5-di-t-butyl-4-hydroxyphenyl) propionate, pentaerythritol tetrakis [3-(3,5-di-t-butyl-4-hydroxyphenyl) propionate], 2,4-bis-(n-octylthio)-6-(4-hydroxy-3,5-di-t-butylanilino)-1,3,5-triazine, 1,3,5-trimethyl-2,4,6-tris (3,5-di-t-butyl-4-hydroxybenzyl) benzene, triethylene glycol-bis[3-(3-t-butyl-5-methyl-4-hydroxyphenyl) propionate], 1,6-hexanediol-bis[3-(3,5-di-t-butyl-4-hydroxyphenyl) propionate], 2,2-thiodiethylene bis[3-(3,5-di-t-butyl-4-hydroxyphenyl) propionate], and N,N'-hexamethylene bis(3,5-di-t-butyl-4-hydroxy-hydrocinnamide), a phenolic antioxidant such as 2,6-di-t-butyl-4-methylphenol, 4,4-methylene bis(2,6-di-t-butylphenol), and an amine antioxidant such as triphenylamine, phenyl-α-naphthylamine, alkylated phenyl-α-naphthylamine, phenothiazine, and alkylated phenothiazine.

Examples of the metal deactivator include benzotriazole and sodium nitrite.

The grease composition for resin lubrication of the present invention can be obtained by mixing the above-described base oils, thickeners, and the extreme pressure additives at a predetermined ratio, and if necessary, mixing the other additives.

In addition, the grease composition for resin lubrication can be obtained by mixing two kinds of base greases, i.e., a fluorine grease containing the fluorine-based base oil and the fluorine-based thickener and a lithium soap grease (or lithium complex soap grease) containing the synthetic hydrocarbon oil and the lithium soap thickener (or lithium complex soap thickener), an extreme pressure additive, and if necessary, mixing the other additives. Alternatively, the grease composition for resin lubrication may be produced by mixing one of the above-described base greases, the remaining base oil, the thickener, and the extreme pressure additive, and if necessary, mixing the other additives.

Generally, the content of the thickener with respect to the base grease is about 10% to 30% by mass. For example, in the above two kinds of base greases, the content of thickener with respect to each of the base greases may be 15% to 30% by mass in the fluorine-based thickener, and 10% to 20% by mass in the lithium soap thickener or the lithium complex soap thickener, respectively.

The grease composition for resin lubrication according to an embodiment of the present invention is relatively soft grease because it is applied to the resin sliding surface, and preferably has a worked penetration in the range of 265 to 340.

The present invention is not limited to the embodiments and specific examples described herein, and various changes and modifications are possible within the scope of the technical idea described in the claims.

EXAMPLES

Hereinafter, the present invention will be described in more detail with reference to the Examples. However, the present invention is not limited to the Examples.

[Evaluation of Grease Composition for Resin Lubrication]

The grease compositions used in Examples 1 to 8 and Comparative Examples 1 to 11 were prepared in blending amounts indicated in the following Tables 1 and 2.

In addition, the detail of each component used for preparation of grease and abbreviation thereof are as follows.

(a) Base oils (a1) Fluorine-based base oil: Linear perfluoropolyether (PFPE) oil (kinetic viscosity at 40° C.: 85 $mm^2/s$)

(a2) Synthetic hydrocarbon oil: polyalphaolefin (PAO)

(a2-1) PAO1 (kinetic viscosity at 40° C.: 200 $mm^2/s$)

(a2-2) PAO2 (kinetic viscosity at 40° C.: 100 $mm^2/s$)

(a2-3) PAO3 (kinetic viscosity at 40° C.: 48 $mm^2/s$)

(a2-4) PAO4 (kinetic viscosity at 40° C.: 30 $mm^2/s$)

(a2-5) PAO5 (kinetic viscosity at 40° C.: 300 $mm^2/s$)

(a2-6) PAO6 (kinetic viscosity at 40° C.: 38 $mm^2/s$)

(b) Thickeners (b1) Fluorine-based thickener: PTFE (polytetrafluoroethylene) resin, particle size of 0.3 μm to 25 μm In accordance with <Particle Size Analysis-laser Diffraction and Scattering Method> based on JIS Z 8825, an average particle size of the PTFE resin was measured using a fluorine-based surfactant as a solvent for dispersing the PTFE resin, with a laser diffraction scattering particle size distribution analyzer (manufactured by Horiba, Ltd., Model No.: LA-920).

(b2) Li soap thickener: 12OHLi soap (lithium 12-hydroxystearate)

(b3) Ba complex soap thickener: barium complex soap of sebacic acid and monostearylamide (b4) Urea thickener: Urea compound containing aliphatic urea (c) Additives (c1) Extreme pressure additive (c1-1) Phosphorus extreme pressure additive 1: Tricresyl phosphate (TCP), Product name "tritolyl phosphate", made by Fujifilm Wako Pure Chemical Industries, Ltd.

(c1-2) Phosphorus extreme pressure additive 2: Triphenoxy phosphine sulfide (TPPS), "IRGALUBE TPPT" prepared by BASF Japan Ltd.

(c1-3) Macromolecular ester extreme pressure additive, "Perfad 8400", prepared by Croda Japan KK.

(c2) Antioxidant: Diarylamine antioxidant, "IRGANOX L57" prepared by BASF Japan Ltd.

Regarding the properties of the obtained grease composition, the lubricant properties (friction and wear test) and the adhesiveness (viscosity measurement test) were evaluated according to the following procedure.

Note that, the worked penetration of each of the grease compositions of the above Examples and Comparative Examples was 280 (in accordance with the measurement of JIS K 2220 7).

<Method of Test>

1. Evaluation of Lubricant Properties: Friction and Wear Test

Figure 3:
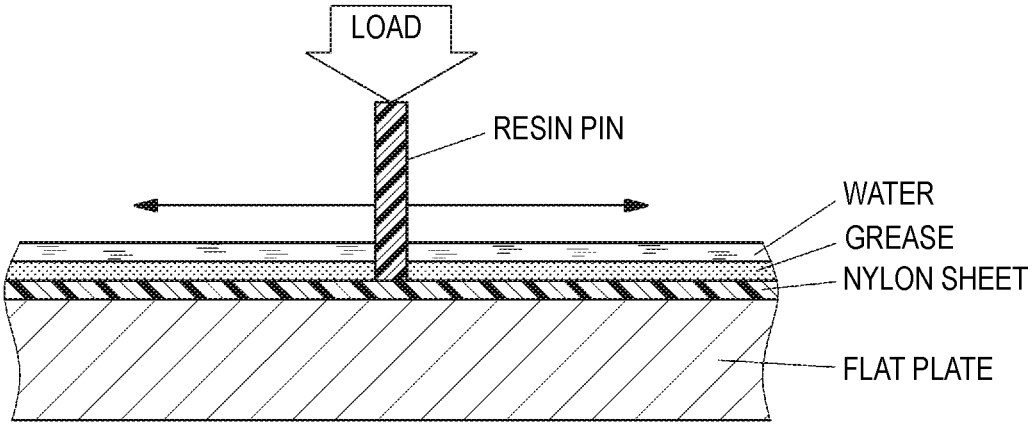
FIG. 3 is a conceptual view of a device used in the friction and wear test performed in Examples.

As shown in the conceptual view of the friction and wear test illustrated in FIG. 3, a nylon sheet was provided on a flat plate, and then each grease composition was applied to the nylon sheet to form a laminated sample, and the laminated sample was immersed in water. A probe (resin pin) was slid with a predetermined load on the surface of the nylon sheet of the laminated sample in the condition immersed in the water, and the coefficient of friction at that time was measured. During a sliding cycle of 1000 strokes, measurements were performed, and the maximum value of the obtained values was considered as the coefficient of friction in each measurement.

The test was conducted three times for each of the grease compositions of the Examples and Comparative Examples, and the average value of three times was considered as the coefficient of friction of each grease composition, and the lubricant properties were evaluated based on the evaluation criteria as shown below.

Figure 5B:
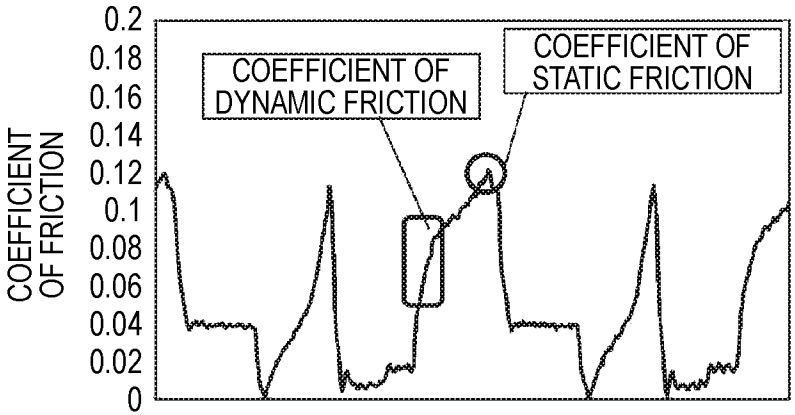
FIG. 5B illustrates the behavior of variation of the coefficient of friction in the grease composition of Comparative Example 3 observed during the friction and wear test.
Figure 5A:
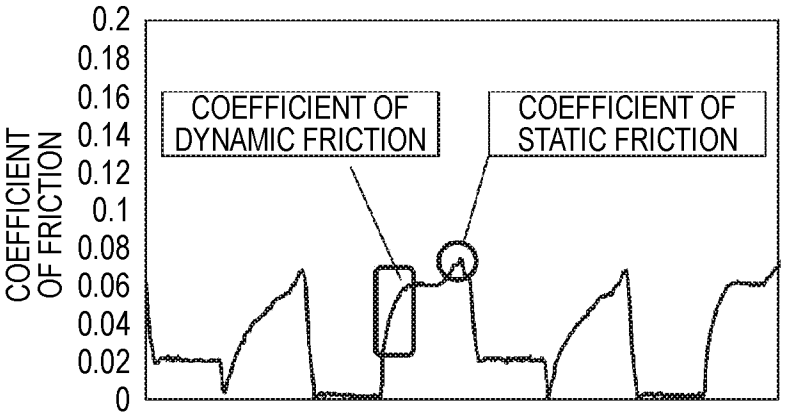
FIG. 5A illustrates the behavior of variation of the coefficient of friction in the grease composition of Example 2 observed during the friction and wear test.

In addition, FIG. 5A and FIG. 5B show the variation of the coefficient of friction observed in the grease compositions of Example 2 and Comparative Example 3 respectively when the probe slides (Example 2: FIG. 5A, Comparative Example 3: FIG. 5B).

<Test Conditions>

Measurement device: Load fluctuation type friction and wear test system HHS2000 manufactured by Shinto Scientific Co., Ltd.

Measurement condition: Underwater test

Probe: resin pin (Pin diameter: 2.5 mm, Pin type: PPA resin)

Feed scale: 1 mm

Load: 1000 g

Sliding speed: 1.0 mm/s

Sliding cycle: 1000 strokes

<Evaluation Criteria>

In test conditions of the present example, the lower the coefficient of friction, the better the lubricant properties are.

It has been verified that when the coefficient of friction value exceeds 0.1, a tear in the waterproof film occurs during the test with actual switch as described later, and thus the coefficient of friction value should be preferably 0.1 or lower. Therefore, the criteria are defined as follows:

A (preferable): the coefficient of friction is 0.1 or lower

N (not acceptable): the coefficient of friction is higher than 0.1

2. Adhesiveness Evaluation: Viscosity Measurement Test

Figure 4:
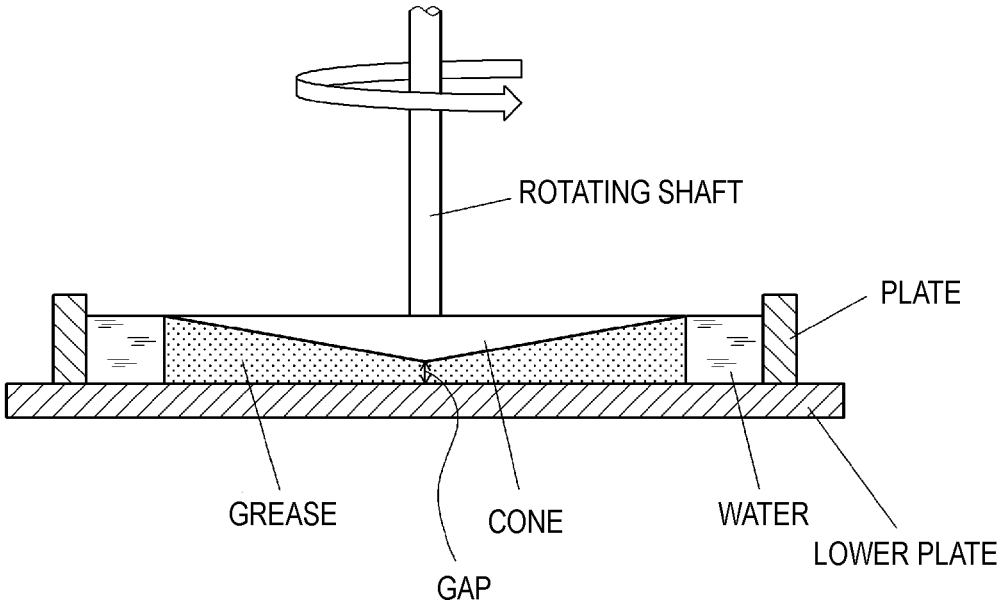
FIG. 4 is a conceptual view of a rheometer used in a viscosity measurement test performed in Examples.

The viscosity was measured using the rheometer (rotational viscometer) as illustrated in FIG. 4 with reference to DIN 51810 under the following procedure and test conditions.

<Test Procedure>

For each grease composition, after applying the grease composition on the lower plate, the whole plate was immersed in water. The cone plate was lowered from the upper part to form a predetermined gap between the tip of the cone plate and the lower plate, and the excess of grease was removed. The cone plate was rotated at 300 $s^{-1}$, the viscosity was measured for one minute, and the measured value after one minute was set as a value of the viscosity in each measurement.

Regarding each of the grease compositions of the Examples and Comparative Examples, the test was conducted three times, and the average value of three times was used as the value of viscosity of each grease composition, and the adhesiveness was evaluated based on the evaluation criteria as shown below.

<Test Conditions>

Measurement device: rheometer (MCR302 manufactured by Anton Paar GmbH)

Measurement Condition: Underwater test

Measurement Temperature: 25° C.

Measurement tool: cone plate with a diameter of 25 mm (Product number: CP25-1/TG)

Gap between lower plate and cone plate (tip): 0.108 mm

Shear rate: 300 [1/s]

Measurement time: 1 minute

<Evaluation Criteria>

In the test condition of the present example, the higher viscosity, the better adhesiveness is.

If the viscosity measurement value is less than 4 Pa·s, the adhesiveness tends to deteriorate, and the grease may be removed with time, wear may be promoted, and the switch feeling (click feeling) may worsen, and thus the viscosity should be preferably 4.0 Pa·s or higher. Therefore, the criteria are defined as follows:

A (preferable): the viscosity is 4.0 Pa·s or higher

N (not acceptable): the viscosity is less than 4.0 Pa·s

The results are indicated in Tables 1 and 2. The blending amount in the table (% by mass) is a value with respect to the total mass of the composition.

In addition, FIG. 6 illustrates the measured value of the viscosity (Pa·s) of the grease composition and FIG. 7 illustrates the value of the coefficient of friction, both with respect to the value of the kinetic viscosity at 40° C. of the synthetic hydrocarbon oil (polyalphaolefin) in the grease composition of Examples 1 to 4, and Comparative Examples 8 and 9.

FIG. 8 illustrates the value of the coefficient of friction with respect to the measured value of the viscosity (Pa·s) in the grease composition of Examples 1 to 8 and Comparative Examples 1 to 11.

TABLE 1

| (Blending amount: % by mass) | | | Examples | | | | | | | |
|---|---|---|---|---|---|---|---|---|---|---|
| | | | 1 | 2 | 3 | 4 | 5 | 6 | 7 | 8 |
| Base oils | (a1) Fluorine-based base oil | Linear PFPE oil (85 $mm^2/s$)*1 | 40 | 40 | 40 | 40 | 40 | 40 | 60 | 20 |
| | (a2) Synthetic hydrocarbon oil | (a2-1) PAO1 (200 $mm^2/s$)*1 | 42 | | | | | | | |
| | | (a2-2) PAO2 (100 $mm^2/s$)*1 | | 42 | | | | | | |
| | | (a2-3) PAO3 (48 $mm^2/s$)*1 | | | 42 | | 42 | 42 | 20 | 64 |
| | | (a2-4) PAO4 (30 $mm^2/s$)*1 | | | | 42 | | | | |
| | | (a2-5) PAO5 (300 $mm^2/s$)*1 | | | | | | | | |
| | | (a2-6) PAO6 (18 $mm^2/s$)*1 | | | | | | | | |
| Thickeners | (b1) Fluorine-based thickener | PTFE resin | 10 | 10 | 10 | 10 | 10 | 10 | 15 | 5 |
| | (b2) Li soap thickener | Lithium soap thickener | 6 | 6 | 6 | 6 | 6 | 6 | 3 | 9 |
| | (b3) Ba complex soap thickener | Barium complex soap | | | | | | | | |

TABLE 1-continued

| (Blending amount: % by mass) | | | Examples 1 | 2 | 3 | 4 | 5 | 6 | 7 | 8 |
|---|---|---|---|---|---|---|---|---|---|---|
| | (b4) Urea thickener | Aliphatic urea compound | | | | | | | | |
| Additives | (c1) Extreme pressure additive | (c1-1) Phosphorus extreme pressure additive 1: TCP | 1 | 1 | 1 | 1 | | | 1 | 1 |
| | | (c1-2) Phosphorus extreme pressure additive 2: TPPS | | | | | 1 | | | |
| | | (c1-3) Macromolecular ester extreme pressure additive | | | | | | 1 | | |
| | (c2) Additives | (c2) Antioxidant | 1 | 1 | 1 | 1 | 1 | 1 | 1 | 1 |
| Evaluation results | Evaluation of lubricant properties | Coefficient of friction (actual value) | 0.0971 | 0.0864 | 0.0880 | 0.0842 | 0.0919 | 0.0948 | 0.0812 | 0.0978 |
| | Friction and wear test | Determination*2 | A | A | A | A | A | A | A | A |
| | Adhesiveness Evaluation | Viscosity Pa · s (actual value) | 5.3 | 5.0 | 4.7 | 4.1 | 4.5 | 4.8 | 4.1 | 5.1 |
| | Viscosity Measurement Test | Determination*3 | A | A | A | A | A | A | A | A |

Note:

*1The value in parentheses means kinetic viscosity at 40° C.

*2A (preferable): coefficient of friction is 0.1 or lower, N (not acceptable): coefficient of friction is higher than 0.1

*3A (preferable): viscosity is 4.0 Pa · s or higher, N (not acceptable): viscosity is less than 4.0 Pa · s

TABLE 2

| (Blending amount: % by mass) | | | Comparative Example 1 | 2 | 3 | 4 | 5 | 6 | 7 | 8 | 9 | 10 | 11 |
|---|---|---|---|---|---|---|---|---|---|---|---|---|---|
| Base oils | (a1) Fluorine-based base oil | Linear PFPE oil (85 $mm^2/s$)*1 | 80 | | | | | 40 | 40 | 40 | 40 | 40 | 40 |
| | (a2) Synthetic hydrocarbon oil | (a2-1) PAO1 (200 $mm^2/s$)*1 | | 84 | | | | | | | | | |
| | | (a2-2) PAO2 (100 $mm^2/s$)*1 | | | 84 | | | | | | | 43 | |
| | | (a2-3) PAO3 (48 $mm^2/s$)*1 | | | | 84 | | 38 | 42 | | | | 43 |
| | | (a2-4) PAO4 (30 $mm^2/s$)*1 | | | | | 84 | | | | | | |
| | | (a2-5) PAO5 (300 $mm^2/s$)*1 | | | | | | | | 42 | | | |
| | | (a2-6) PAO6 (18 $mm^2/s$)*1 | | | | | | | | | 42 | | |
| Thickeners | (b1) Fluorine-based thickener | PTFE resin | 20 | | | | | 10 | 10 | 10 | 10 | 10 | 10 |
| | (b2) Li soap thickener | Lithium soap thickener | | 12 | 12 | 12 | 12 | | | 6 | 6 | 6 | 6 |
| | (b3) Ba complex soap thickener | Barium complex soap | | | | | | 10 | | | | | |
| | (b4) Urea thickener | Aliphatic urea compound | | | | | | | 6 | | | | |
| Additives | (c1) Extreme pressure additive | (c1-1) Phosphorus extreme pressure additive 1: TCP | | 2 | 2 | 2 | 2 | 1 | 1 | 1 | 1 | | |
| | | (c1-2) | | | | | | | | | | | |

TABLE 2-continued

| (Blending amount: % by mass) | | | Comparative Example 1 | 2 | 3 | 4 | 5 | 6 | 7 | 8 | 9 | 10 | 11 |
|---|---|---|---|---|---|---|---|---|---|---|---|---|---|
| | | Phosphorus extreme pressure additive 2: TPPS (c1-3) Macro-molecular ester extreme pressure additive | | | | | | | | | | | |
| | (c2) Additives | (c2) Antioxidant | | 2 | 2 | 2 | 2 | 1 | 1 | 1 | 1 | 1 | 1 |
| Evaluation results | Evaluation of lubricant properties | Coefficient of friction (actual value) | 0.0904 | 0.1672 | 0.1382 | 0.1694 | 0.112 | 0.1292 | 0.1181 | 0.1103 | 0.0923 | 0.1218 | 0.1323 |
| | Friction and wear test | Determination | A | N | N | N | N | N | N | N | A | N | N |
| | Adhesiveness Evaluation | Viscosity Pa · s (actual value) | 1.2 | 5.1 | 5.3 | 4.8 | 3.8 | 4.9 | 4.6 | 6.2 | 3.4 | 4.5 | 4.5 |
| | Viscosity Measurement Test | Determination | N | A | A | A | N | A | A | A | N | A | A |

Note:
*[1]The value in parentheses means kinetic viscosity at 40° C.
*2: A (preferable): coefficient of friction is 0.1 or lower, N (not acceptable): coefficient of friction is higher than 0.1
*3: A (preferable): viscosity is 4.0 Pa · s or higher, N (not acceptable): viscosity is less than 4.0 Pa · s As described above, FIG. 5A and FIG. 5B show a chart illustrating the behavior of variation in the coefficient of friction observed when the probe slides, in the grease composition of Example 2 and Comparative Example 3 (Example 2: FIG. 5A, Comparative Example 3: FIG. 5B).

As illustrated in FIG. 5A and FIG. 5B, the highest value of the coefficient of friction corresponds to a coefficient of static friction at the moment when the probe starts moving or comes to stop, and it can be clearly confirmed also from this chart that the coefficient of friction is reduced to a lower level in Example 2 (FIG. 5A) compared to Comparative Example 3 (FIG. 5B).

Further, as described above, FIG. 6 illustrates the results of the viscosity measurement test in the grease compositions (Examples 1 to 4, Comparative Examples 8 and 9) in which the value of the kinetic viscosity at 40° C. of the synthetic hydrocarbon oil (polyalphaolefin) is changed from 18 to 300 $mm^2/s$.

The horizontal axis of the graph in FIG. 6 is the value of the kinetic viscosity ($mm^2/s$) at 40° C. of the synthetic hydrocarbon oil (polyalphaolefin), and the vertical axis is the value of the measured viscosity (Pa·s).

In FIG. 6, the arrow parallel to the horizontal axis indicates the range of kinetic viscosity at 40° C. of the synthetic hydrocarbon oil, in which excellent properties were obtained in both the viscosity measurement test and the friction and wear test as described later.

As illustrated in FIG. 6, it could be confirmed that when the kinetic viscosity at 40° C. of the synthetic hydrocarbon oil is lower than 50 $mm^2/s$, the viscosity of the grease composition itself starts to decrease sharply, and when it is lower than 30 $mm^2/s$, the viscosity tends to be lower than 4 Pa·s. That is, regarding the adhesiveness of the grease composition, when the kinetic viscosity at 40° C. of the synthetic hydrocarbon oil is 30 $mm^2/s$ or higher, the excellent property (viscosity: 4 Pa·s or higher) is obtained.

FIG. 7 illustrates the results of the friction and wear test in the grease compositions (Examples 1 to 4, Comparative Examples 8 and 9) in which the value of the kinetic viscosity at 40° C. of the synthetic hydrocarbon oil (polyalphaolefin) is changed from 18 to 300 $mm^2/s$.

The horizontal axis of the graph in FIG. 7 is the value of the kinetic viscosity ($mm^2/s$) at 40° C. of the synthetic hydrocarbon oil (polyalphaolefin), and the vertical axis is the value of the coefficient of friction.

In FIG. 7, the arrow parallel to the horizontal axis indicates the range of kinetic viscosity at 40° C. of the synthetic hydrocarbon oil in which excellent properties were obtained in both the friction and wear test and the viscosity measurement test as described above.

As illustrated in FIG. 7, it could be confirmed that when the kinetic viscosity at 40° C. of the synthetic hydrocarbon oil is higher than 100 $mm^2/s$, the coefficient of friction of the grease composition starts to increase rapidly, and when it is higher than 220 $mm^2/s$, the coefficient of friction tends to be higher than 0.1. That is, regarding the lubricant properties of the grease composition, when the kinetic viscosity at 40° C. of the synthetic hydrocarbon oil is 220 $mm^2/s$ or lower, the excellent properties (coefficient of friction: 0.1 or lower) is obtained.

FIG. 8 illustrates the value of the coefficient of friction with respect to the value of the measured viscosity (Pa·s) in the grease compositions prepared in Examples 1 to 8 and Comparative Examples 1 to 11. In FIG. 8, the grease composition in the optimum region is a grease composition capable of providing the excellent properties in both the viscosity measurement test and the friction and wear test.

As indicated in Table 1, it was confirmed that the grease compositions of Examples 1 to 8 all have the viscosity of 4 Pa·s or higher, the coefficient of friction of 0.1 or lower, the excellent adhesiveness, and the excellent lubricant properties.

As illustrated in Example 3, Example 5, and Example 6, it was found that the extreme pressure additive is suitable in both of a phosphorus additive and a macromolecular ester additive.

Furthermore, as shown in Example 3, Example 7, and Example 8, even in a case where the fluorine-based base oil/fluorine-based thickener, and the synthetic hydrocarbon oil/lithium soap thickener are changed at a wide ratio, the excellent adhesiveness and lubricant properties were obtained.

On the other hand, as indicated in Table 2, the grease composition of Comparative Example 1, which consists of the fluorine-based base oil and fluorine-based thickener, had the coefficient of friction of 0.1 or lower and was excellent in the lubricant properties, but had the viscosity much lower than 4 Pa·s (1.2 Pa·s) and greatly deteriorated adhesiveness.

In the grease compositions of Comparative Examples 2 to 4, which do not contain the fluorine-based base oil and the thickener, but contain the synthetic hydrocarbon oil, the lithium soap thickener and the extreme pressure additive, the viscosity was 4 Pa·s or higher (4.8 to 5.1 Pa·s), and the adhesiveness was excellent, but the coefficient of friction was higher than 0.1 (0.1382 to 0.1694), which indicated poor lubricant properties. Moreover, in Comparative Example 5 in which the kinetic viscosity at 40° C. of the synthetic hydrocarbon oil is relatively low (30 $mm^2/s$), not only the lubricant properties (coefficient of friction: 0.112) but also the adhesiveness (viscosity: 3.8 Pa·s) also became worse, and both properties were not satisfactory.

Furthermore, in place of the lithium soap thickener in the grease composition of Example 3, the grease composition using a barium complex soap thickener (Comparative Example 6) or a urea thickener (Comparative Example 7) had the viscosity higher than 4 Pa·s (4.6 to 4.9 Pa·s), and although the adhesiveness is satisfactory, the coefficient of friction exceeds 0.1 (0.1181 to 0.1292), and thus the lubricant properties were worse compared with Example 3. That is, for the purpose of the present invention, it was confirmed that the selection of the lithium soap thickener is preferable particularly in order to satisfy the lubricant properties.

In addition, compared to the grease compositions of Examples 1 to 4 where the kinetic viscosity at 40° C. of the synthetic hydrocarbon oil is in the range of 30 to 200 $mm^2/s$, the coefficient of friction was higher (0.1103) in Comparative Example 8 using the synthetic hydrocarbon oil having the kinetic viscosity exceeding the above range (300 $mm^2/s$); on the other hand, the viscosity was lower (3.4 Pa·s) in Comparative Example 9 using the synthetic hydrocarbon oil having the kinetic viscosity lower than the above range (18 $mm^2/s$). Thus, it was confirmed that there is a preferable range of the kinetic viscosity of the synthetic hydrocarbon oil.

In addition, compared to the grease compositions of Examples 2, 3, 5, and 6 where the phosphorus extreme pressure additive or the macromolecular ester extreme pressure additive is mixed, the grease compositions of Comparative Examples 10 and 11 with no extreme pressure additive had the coefficient of friction higher than 0.1 (0.1218 to 0.1323), and resulted in poor lubricant properties. The grease compositions of Examples 2, 3, 5 and 6 have the coefficient of friction of 0.1 or lower (0.0864 to 0.0948), and by mixing the extreme pressure additive, the coefficient of friction could be reduced by about 30%.

As described above, the extreme pressure additive is an additive generally mixed for the purpose of reducing the friction and wear between two metal surfaces and preventing seizure. However, in the present invention, it was found that the coefficient of friction is also decreased when applied to the lubrication of the resin sliding surface.

[Performance Evaluation Using Sliding Switch and Gear Device]

Using the grease compositions of Examples and Comparative Examples, tests were performed with a sliding switch and a gear device. In the following description, the example numbers of the grease compositions are also treated as the example numbers of the evaluation of the actual devices.

<Sliding Switch>

Using the grease compositions of Example 3, Comparative Example 1, and Comparative Example 6, a test using a sliding switch was performed.

Using the sliding switch 101 as illustrated in FIG. 1, each of the grease compositions described above was applied to a predetermined locations: a contact portion (lower portion of the slider 110 which is a resin sliding surface) between the contact operation unit 113 in the slider 110 and the second waterproof film 105, and each convex portion 110*a* (the resin sliding surface) of the slider 110. Then, the switch operation of 20,000 cycles was performed in the water. The slider 110 was made of a PPA resin, and the second waterproof film 105 was also made of a PPA resin. After the test the condition of the second waterproof film 105 was observed, and the torque feeling (operation feeling) after switching 20,000 cycles was verified.

In Example 3, even after the sliding switch was operated in the water for 20,000 cycles, the tear of the waterproof film did not occur, and the reduction rate of the torque feeling at the time of switching after 20,000 cycles was as low as 20%.

On the other hand, in Comparative Example 1, although the tear of the waterproof film did not occur after the above test, the decrease in the torque feeling at the time of switching caused by the wear of the slider resin was large, and the reduction rate reached about 50%.

In Comparative Example 6, although the reduction rate in the torque feeling at the time of switching was limited to about 30%, the tear occurred due to the wear caused by the switching operation in the contact portion of the waterproof film with the slider, particularly, in a start/stop portion (in FIG. 1B, a portion where the movable contact 109 was in contact with the second waterproof film 105 when contact operation unit 113 displaced the movable contact 109 through the second waterproof film 105).

Based on the above results, it was confirmed that the sliding switch in which the grease composition of Example 3 was applied to the resin sliding surface suppresses the removal of grease from the resin sliding surface even in the water contact environment, and can maintain excellent lubricant properties of grease.

<Gear Device>

Using the grease compositions of Example 3, Comparative Example 1, and Comparative Example 7, a test using a gear device was performed.

Using the multi-stage gear device 201 as illustrated in FIG. 2, each of the grease compositions was applied to the engagement portion X of the first gear 202 and the second gear 203, the engagement portion Y of the second gear 203 and the third gear 205, a bearing portion 204*a* of the second gear 203, and a bearing portion 206*a* of the third gear 205, and then a durability test as described below was performed. Note that, the first gear 202, the second gear 203, the bearing portion 204*a* of the second gear 203, the third gear 205, and the bearing portion 206*a* of the third gear 205 were made of the PPA resin.

Loading torque: 35 N·cm

Environmental temperature: −30° C. to 85° C. (the environment where water contacts by dew condensation due to temperature change)

Test procedure: An arm and a weight (applied load) to apply the loading torque was installed on the actuator output shaft 212, and reciprocation (one cycle of 180-degree rotation in clockwise and counter-clockwise directions at the output) of the arm and weight installed in the actuator output shaft 212 was continuously performed 45,000 cycles (about 15 seconds per cycle) under the above temperature condition.

The change rate of the output torque was determined by measuring the output torque of the gear device before and after the test.

In Example 3, the torque change rate between the early stage of the test and after the test was small, and desirable result in that the durability of the lubricating properties is excellent was obtained.

On the other hand, in Comparative Example 1, the output torque after the test was reduced by about 60% as compared to before the start of the test. After the test, when the gear device was disassembled, it was observed that the grease composition was not adhering to the engagement portion (tooth surface) of the gear where the grease composition was applied. Therefore, it is likely that a lubrication failure and subsequent increase in the frictional force occurred and caused the reduction of the output torque.

In Comparative Example 7, as indicated in Table 2, the coefficient of friction of the grease composition was high, and the initial output torque was already low before the start of the test, and it was confirmed that the lubricant properties are poor.

As described above, the grease composition for resin lubrication according to an embodiment of the present invention which contains the fluorine-based base oil and the synthetic hydrocarbon oil, the fluorine-based thickener, the lithium soap thickener or the lithium complex soap thickener, and the extreme pressure additive was confirmed to be excellent in the adhesiveness and the lubricant properties when applied to the resin sliding surface, and by the application of this grease composition, it is possible to provide the resin sliding member with prolonged service life by reducing the friction and wear.

As described above, although the present invention has been particularly shown and described in detail with reference to specific preferred embodiments, the present invention is not limited to the above-described embodiments, and modification or improvement which can achieve the object of the present invention are included in the scope of the present invention.

What is claimed is:

1. A grease composition for lubrication of a sliding surface made of a resin, comprising:

a fluorine-based base oil;

a synthetic hydrocarbon oil;

a fluorine-based thickener;

a lithium soap thickener; and an extreme pressure additive, wherein the synthetic hydrocarbon oil has a kinetic viscosity at 40° C. of 30 to 220 $mm^2/s$, and the extreme pressure additive is at least one selected from the group consisting of tricresyl phosphate, triphenoxyphosphine sulfide and macromolecular ester, and the grease composition has a worked penetration in the range of 265 to 340.

2. A sliding member comprising a sliding surface made of a resin wherein the grease composition according to claim 1 is applied to the sliding surface.

3. The sliding member according to claim 2, wherein the sliding member is a sliding switch, wherein the switch includes a waterproof film made of resin and a slider made of resin, the slider is configured to contact with the waterproof film while sliding and the grease composition is applied to at least one of the waterproof film and slider.

4. The sliding member according to claim 2, wherein the sliding member is a gear device, including a first gear made of resin, wherein the grease composition is applied to the first gear.

5. A sliding member comprising a sliding surface made of a resin, wherein the sliding member is a sliding switch including a waterproof film made of resin and a slider made of resin, wherein the slider is configured to contact with the waterproof film while sliding and the grease composition is applied to at least one of the waterproof film and slider, wherein a grease composition is applied to the sliding surface, the grease composition comprising:

a fluorine-based base oil;

a synthetic hydrocarbon oil;

a fluorine-based thickener;

a lithium soap thickener; and an extreme pressure additive, wherein the synthetic hydrocarbon oil has a kinetic viscosity at 40° C. of 30 to 220 $mm^2/s$, and the extreme pressure additive is at least one selected from the group consisting of tricresyl phosphate, triphenoxyphosphine sulfide and macromolecular ester.

* * * * *